US011705296B2

(12) United States Patent
Joyce et al.

(10) Patent No.: US 11,705,296 B2
(45) Date of Patent: Jul. 18, 2023

(54) CURRENT SOURCE CONTACTOR DRIVES WITH ECONOMIZERS

(71) Applicant: Hamilton Sundstrand Corporation, Charlotte, NC (US)

(72) Inventors: Thomas P. Joyce, Rockford, IL (US); Jordan K. Vanevenhoven, Rockford, IL (US); Natalie Filipski, Saint Charles, IL (US)

(73) Assignee: Hamilton Sundstrand Corporation, Charlotte, NC (US)

( * ) Notice: Subject to any disclaimer, the term of this patent is extended or adjusted under 35 U.S.C. 154(b) by 0 days.

(21) Appl. No.: 17/825,472

(22) Filed: May 26, 2022

(65) Prior Publication Data

US 2022/0285116 A1 Sep. 8, 2022

Related U.S. Application Data

(63) Continuation of application No. 16/821,654, filed on Mar. 17, 2020, now Pat. No. 11,488,798.

(51) Int. Cl.

| | |
|---|---|
| ***H01H 9/54*** | (2006.01) |
| ***H01H 47/32*** | (2006.01) |
| ***H01H 47/02*** | (2006.01) |

(52) U.S. Cl.

CPC ..... *H01H 47/325* (2013.01); *H01H 9/542* (2013.01); *H01H 47/02* (2013.01); *H01H 2009/544* (2013.01)

(58) Field of Classification Search

CPC .... H03K 17/161; H03K 17/302; H03K 17/56; H03K 17/567; H03K 17/60; H03K 17/687; H03K 17/6871; H03K 17/16; H03K 17/30; H03K 17/601; H03K 17/64; H03K 17/691; H03K 17/731; H03K 17/10; H03K 17/102; H03K 17/107; H03K 17/12; H03K 17/122; H03K 17/127; H03K 19/00346; H03K 19/00353; H03K 19/00361; H03K 19/003;

(Continued)

(56) References Cited

U.S. PATENT DOCUMENTS

| | | | |
|---|---|---|---|
| 3,590,334 | A | 6/1971 | Baker |
| 4,720,762 | A | 1/1988 | Estes |

(Continued)

OTHER PUBLICATIONS

Extended European Search Report dated Aug. 9, 2021, issued during the prosecution of European Patent Application No. EP 21159967.5.

*Primary Examiner* — Bryan R Perez

(74) *Attorney, Agent, or Firm* — Locke Lord LLP; Joshua L. Jones; Scott D. Wofsy

(57) ABSTRACT

A system includes a contactor operatively connected to a coil for actuating the contactor to open and close a circuit. A pass element includes a source, a drain, and a gate, wherein the drain is electrically connected to the coil, and wherein the coil is in series between the pass element and ground. A voltage source is connected to the source of the pass element to pass current into the coil when the pass element is in a pass state. A current source control circuit with economizer is operatively connected to the gate of the pass element. A delay circuit is operatively connected to the current source control circuit with economizer and to a command line to command a lower current for holding the contactor closed after a delay has expired for the contactor to transition.

5 Claims, 3 Drawing Sheets

(58) Field of Classification Search
CPC ..... H03K 19/00307; H03K 19/00315; H04L 25/026; H01H 9/542; H01H 2009/544; H01H 2047/008; H01H 47/00; H01H 47/22; H01H 47/002; H01H 47/325; H01H 47/32; H01H 47/02; H01H 47/001; H01H 47/226; H01H 47/26; H01H 47/223; H01H 47/043; H01H 47/04; H01H 47/18; H01H 47/06; H01H 47/16; H01H 47/08; H01H 47/10
See application file for complete search history.

(56) References Cited

U.S. PATENT DOCUMENTS

| | | | | |
|---|---|---|---|---|
| 4,922,363 | A | 5/1990 | Long et al. | |
| 5,644,283 | A | 7/1997 | Grosse-Wilde et al. | |
| 5,999,396 | A | 12/1999 | Streich | |
| 7,268,994 | B2 | 9/2007 | Kondo | |
| 10,546,706 | B2 | 1/2020 | Meid | |
| 2002/0167777 | A1* | 11/2002 | Parisi | H01H 47/325 361/154 |
| 2006/0098376 | A1 | 5/2006 | Satoh et al. | |
| 2009/0153117 | A1* | 6/2009 | Yabe | H03K 7/08 323/282 |
| 2010/0027183 | A1 | 2/2010 | Di Maio et al. | |
| 2010/0289603 | A1 | 11/2010 | Meid | |
| 2017/0092449 | A1 | 3/2017 | Thornton et al. | |
| 2018/0288842 | A1* | 10/2018 | Ding | H05B 45/382 |
| 2019/0131047 | A1 | 5/2019 | Priest | |

* cited by examiner

CURRENT SOURCE CONTACTOR DRIVES WITH ECONOMIZERS

CROSS-REFERENCE TO RELATED APPLICATIONS

This is a continuation of U.S. patent application Ser. No. 16/821,654 filed Mar. 17, 2020 the content of which is incorporated by reference herein in its entirety.

BACKGROUND

1. Field

The present disclosure relates to power distribution systems, and more particularly to electrical power generation and distribution system (EPGDS) contactors such as used in aerospace applications.

2. Description of Related Art

Electrical power generation and distribution system (EPGDS) contactors often have built-in economizers which switch from a high current "pull-in" mode, to a lower current "hold" mode, for reduced power dissipation in the contactor coil and coil drive. The failure of the economizer can either cause the coil drive circuitry to trip on overcurrent and inadvertently de-energize the contactor, or may not be detectible if the pull-in current is below the overcurrent threshold.

The conventional techniques have been considered satisfactory for their intended purpose. However, there is an ever present need for improved systems and methods for EPGDS contactors. This disclosure provides a solution for this need.

SUMMARY

A system includes a contactor including a contact that is operatively connected to a coil for actuating the contactor to open and close a circuit. A pass element includes a source, a drain, and a gate, wherein the drain is electrically connected to the coil, and wherein the coil is in series between the pass element and ground. A voltage source is connected to the source of the pass element to pass current into the coil when the pass element is in a pass state. A current source control circuit is operatively connected to the gate of the pass element. The current source control circuit with economizer is configured to control the gate of the pass element to provide a first current to the coil to close the contactor and to provide a second current lower than the first current to the coil after the contactor is closed to hold the contactor closed. A close command line is operatively connected to the current source control circuit to signal the current source control circuit to close or open the contactor. A delay circuit is operatively connected to the current source control circuit and to the command line to command a lower current for holding the contactor closed after a delay has expired for the contactor to transition.

The delay circuit can be connected to the current source control circuit through an economizer that includes a main line running from the voltage source to ground. The main line can include a Zener diode connected in series with a resistor and a bipolar junction transistor (BJT). The Zener diode can be connected between the voltage source and the resistor, and the resistor can be connected between the Zener diode and the BJT. The delay circuit can be electrically connected to a base of the BJT. The Zener diode can have a Zener voltage below which the Zener diode inhibits current flowing from the voltage source to the resistor and the BJT. A secondary pass element can have a gate connected to a node between the Zener diode and the resistor and the secondary pass element can have a source connected to the voltage source.

The current source control circuit can include a linear regulator based current source. The linear regulator based current source can include an operational amplifier. The operational amplifier can include a non-inverting input connected at a voltage divider node between a first resistor and a second resistor. The first and second resistors can connect in series between the voltage source and floating ground (operational amplifier negative rail), wherein the first resistor is connected between the voltage source and the voltage divider node. A third resistor can be connected between the drain of the secondary pass element and the non-inverting input of the operational amplifier. The third resistor can be connected in parallel with the first resistor when the secondary pass element is on.

The operational amplifier can include a non-inverting input connected at a voltage divider node between a first resistor and a second resistor. The first and second resistors can connect in series between the voltage source and floating ground (operational amplifier negative rail). The first resistor can be connected between the voltage source and the voltage divider node. The secondary pass element can be connected in series between the voltage source and the first resistor.

The current source control circuit can include a bipolar junction transistor (BJT) based current source. The delay circuit can be connected to the close command line through an inverter gate. The BJT based current source can include a BJT connected between the voltage source and the gate of the pass element. A base of the BJT can connect to a voltage divider node between a first resistor and a second resistor connected in series with one another between the voltage source and the gate of the pass element. A drain of the secondary pass element can connect to the voltage divider node through a third resistor.

The close command line can connect to a second line running from the voltage source to ground. The second line can include in order running from the voltage source to ground, a Zener diode, a resistor, and a bipolar junction transistor (BJT), wherein the Zener diode has a Zener voltage configured to inhibit current flowing to the resistor and BJT below the Zener Voltage, and wherein the close command line connects to a base of the BJT.

A method includes signaling a current source control circuit to close a contactor. The method includes signaling a delay circuit to start a countdown, supplying a first current to the contactor while the contactor is transitioning from open to closed in a pull-in mode of the contactor, and supplying a second current to the contactor after the contactor is closed in a hold mode of the contactor. The second current is lower than the first current, and supplying the second current is in response to the delay circuit completing the count down.

Supplying the second current can include reversing current through a Zener diode. Supplying the first current and supplying the second current can include using a linear regulator current source. It is also contemplated that supplying the first current and supplying the second current can include using a bipolar junction transistor (BJT) circuit. Supplying the first current and supplying the second current can be accomplished by a drive wherein the drive is a current source rather than an on/off switch to guarantee coil current. The drive can command a different current during pull-in than during the hold mode.

These and other features of the systems and methods of the subject disclosure will become more readily apparent to those skilled in the art from the following detailed description of the preferred embodiments taken in conjunction with the drawings.

BRIEF DESCRIPTION OF THE DRAWINGS

So that those skilled in the art to which the subject disclosure appertains will readily understand how to make and use the devices and methods of the subject disclosure without undue experimentation, preferred embodiments thereof will be described in detail herein below with reference to certain figures, wherein.

DETAILED DESCRIPTION OF THE PREFERRED EMBODIMENTS

Figure 1:
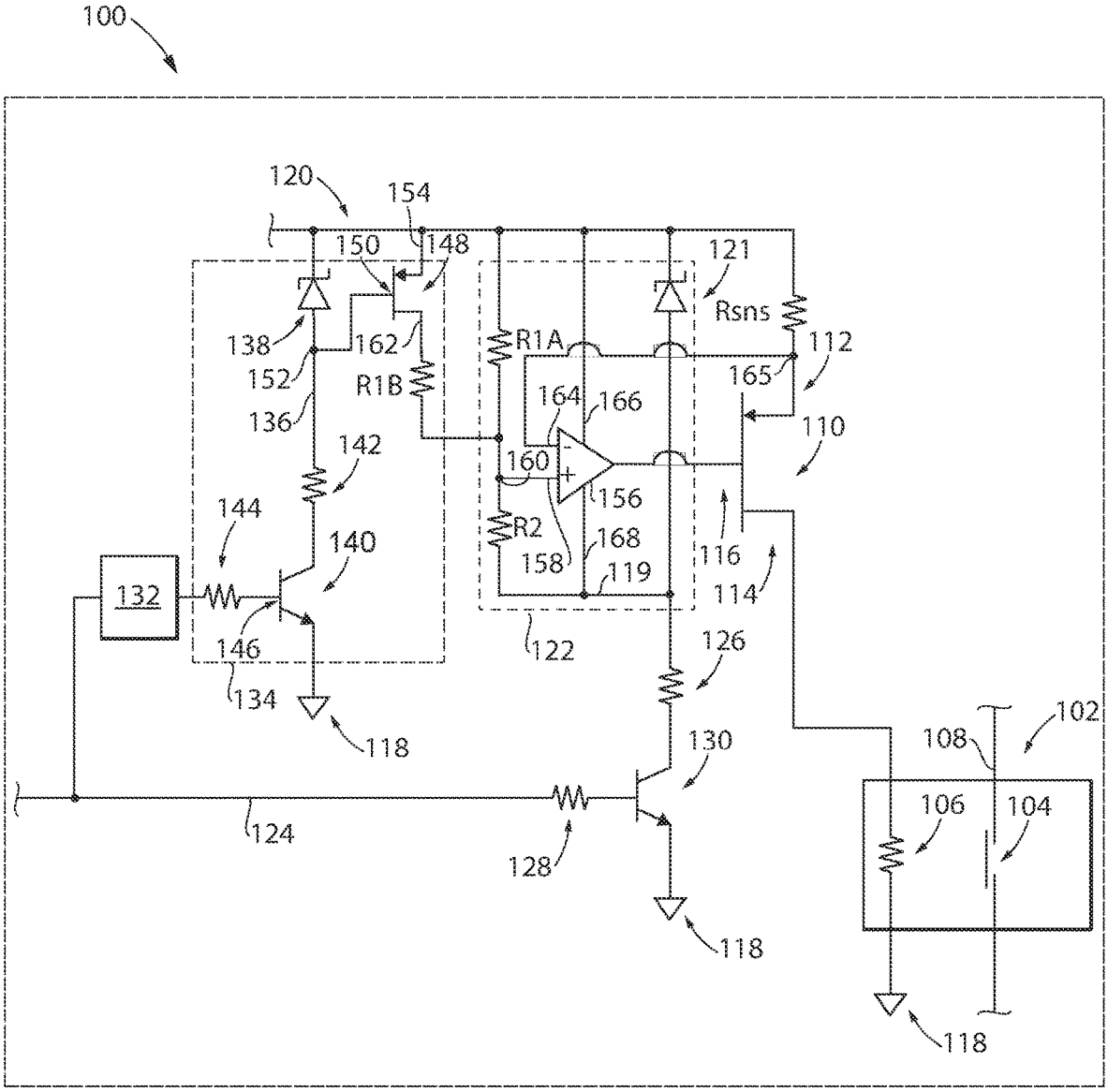
FIG. 1 is a schematic perspective view of an embodiment of a system constructed in accordance with the present disclosure, showing a linear regulator based current source.

Reference will now be made to the drawings wherein like reference numerals identify similar structural features or aspects of the subject disclosure. For purposes of explanation and illustration, and not limitation, a partial view of an embodiment of a system in accordance with the disclosure is shown in FIG. 1 and is designated generally by reference character 100. Other embodiments of systems in accordance with the disclosure, or aspects thereof, are provided in FIGS. 2-3, as will be described. The systems and methods described herein can be used to improve economizer operations using a current source rather than an on/off switch to guarantee coil current, e.g., in aerospace applications.

The system 100 includes a contactor 102 that includes a contact 104 operatively connected to a coil 106 for actuating the contactor 102 to open and close a circuit 108. A pass element 110 includes a source 112, a drain 114, and a gate 116. The drain 114 is electrically connected to the coil 106, and wherein the coil 106 is in series between the pass element 110 and ground 118. A voltage source 120 is connected to the source 112 (through the resistor Rsns) to pass current into the coil 106 when the pass element 110 is in a pass state. A current source control circuit 122 is operatively connected to the gate 116 of the pass element 110. The current source control circuit 122 is configured to control the gate 116 of the pass element to provide a first current to the coil 106 to close the contactor 102 and to provide a second current lower than the first current to the coil 106 after the contactor 102 is closed to hold the contactor 102 closed. A close command line 124 is operatively connected (through resistors 126, 128 and bipolar junction transistor (BJT) 130 arranged as shown in FIG. 1) to the current source control circuit 122 to signal the current source control circuit 122 to close or open the contactor 102. When BJT 130 is closed, it provides a fixed voltage source across the supply rails 166, 168 of the operational amplifier 156 which are in parallel with the Zener diode 121. A delay circuit 132 is operatively connected between the command line 124 and the economizer 134 to command a lower current for holding the contactor 102 closed after a delay has expired for the contactor 102 to transition.

The delay circuit 132 is connected to the current source control circuit 122 through an economizer 134 that includes a main line 136 running from the voltage source 120 to ground 118. The main line 136 includes a Zener diode 138 connected in series with a resistor 142 and a bipolar junction transistor (BJT) 140 with the Zener diode 138 connected between the voltage source 120 and the resistor 142, as shown in FIG. 1. The delay circuit 132 connects to a base 146 of the BJT 140 through a resistor 144 as shown in FIG. 1. The Zener diode 138 can have a Zener voltage below which the Zener diode 138 inhibits current flowing from the voltage source 120 to the resistor 142 and the BJT 140. A secondary pass element 148 has a gate 150 connected to a node 152 between the Zener diode 138 and the resistor 142. The secondary pass element 148 has a source 154 connected to the voltage source 120.

The current source control circuit 122 includes a linear regulator based current source. The linear regulator based current source includes an operational amplifier 156. The operational amplifier 156 includes a non-inverting input 158 connected at a voltage divider node 160 between a first resistor R1A and a second resistor R2. The first and second resistors R1A, R2 connect in series between the voltage source 120 and a floating ground 119 (which is at a voltage of the voltage source 120 minus the Zener voltage of the Zener diode 121), with the first resistor R1A between the voltage source 120 and the voltage divider node 160. When transistor 130 switches on, it provides a path to reverse-bias the Zener diode 121 through resistor 126, and the resistor 126 drops the rest of the voltage. A third resistor R1B is connected between the drain 162 of the secondary pass element 148 and the non-inverting input 158 of the operational amplifier 156. The third resistor R1B is connected in parallel with the first resistor R1A when the secondary pass element 148 is closed, but R1B is disconnected from the circuit when the secondary pass element 148 is open.

The operational amplifier includes an inverting input 164 connected to a node 165 between the current sense resistor Rsns and the source 112 of the pass element 110. The operational amplifier also has a positive power supply 166 connected to the power supply 120, a negative power supply 168 connected to the floating ground 119, and a voltage output connected to the gate 116 of the pass element as shown in FIG. 1.

Figure 2:
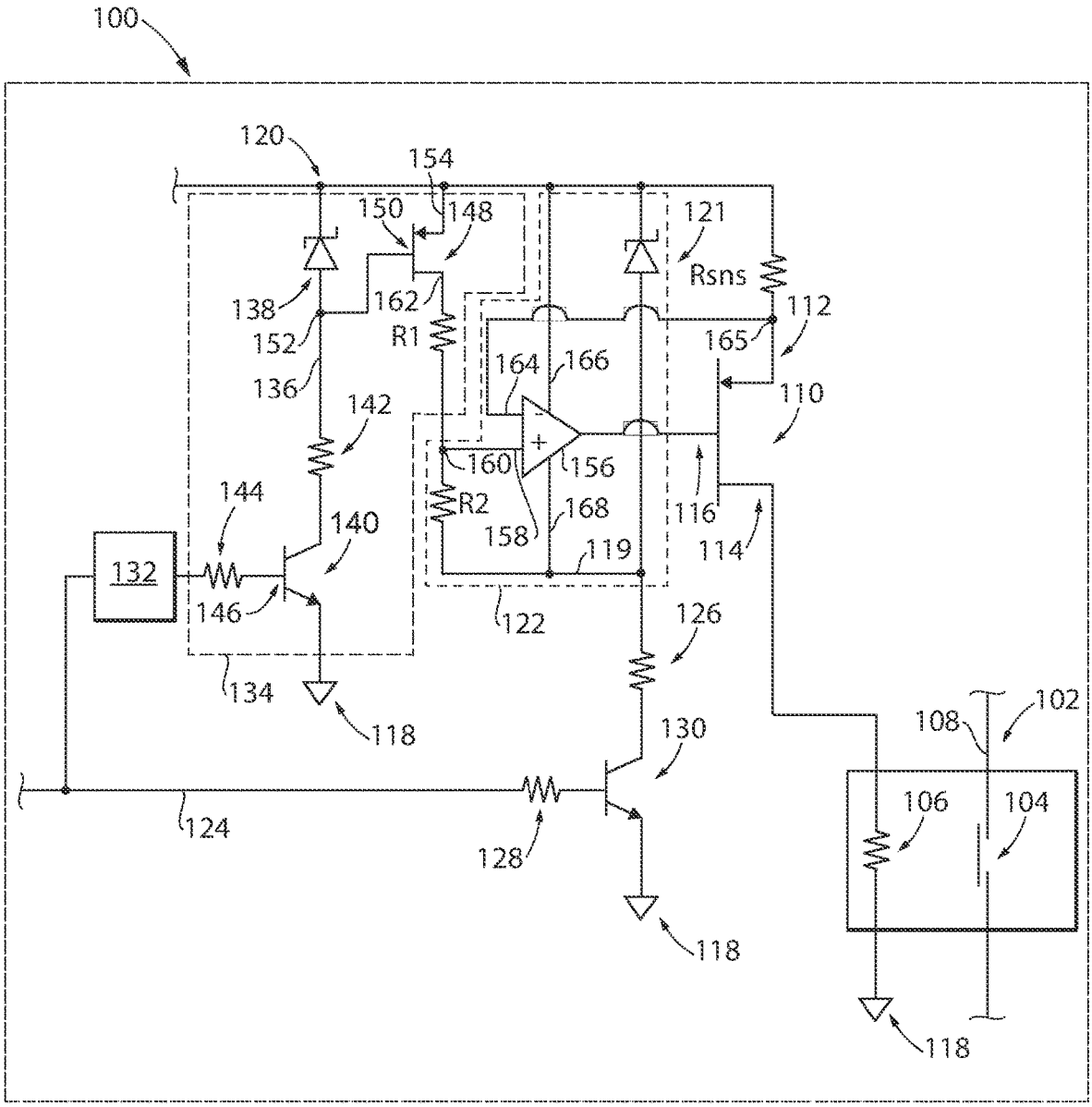
FIG. 2 is a schematic perspective view of an embodiment of a system constructed in accordance with the present disclosure, showing another configuration of a linear regulator based current source.

With reference now to FIG. 2, in another configuration of the system 100 is shown, with a current source control circuit 122, a delay circuit 132, and an economizer 134 similar to that shown in FIG. 1. The operational amplifier 156 can include a non-inverting input 158 connected at a voltage divider node 160 between a first resistor R1 of the economizer 134 and a second resistor R2 of the current source control circuit 122. The first and second resistors R1, R2 connect in series with one another between the drain 162 of the secondary pass element 148 and floating ground 119, with the first resistor R1 connected between the drain 162 of the secondary pass element 148 and the voltage divider node 160. The R1, R2 network is connected to the voltage source 120 only when the secondary pass element 148 is on, and otherwise the R1, R2 network connects the non-inverting input of operational amplifier 156 to its low rail, which causes the current source control circuit 122 to command maximum current. The secondary pass element 148 is connected in series between the voltage source 120 and the first resistor R1.

In the configuration of FIG. 1, when a signal is sent on the command line 124, the delay circuit 132 begins a countdown and the first, higher current for pull-in mode is applied to the coil 106. The resistor R1A has current in this state. After the countdown is completed, the resistor R1B has current flow in parallel with the current flowing in R1A, lowering the current commanded by the voltage output of the operation amplifier 156, to lower the current applied to the coil 106 for hold mode in the contactor 102. In the configuration of FIG. 2, when a signal is sent on the command line 124, the delay circuit 132 begins a countdown and the first, higher current for pull-in mode is applied to the coil 106. Resistor R1 is removed from the circuit in this state. After the countdown is completed, the resistor R1 is connected to the voltage source 120, lowering the current commanded by in the voltage output of the operational amplifier 156, to lower the current applied to the coil 106 for hold mode.

Figure 3:
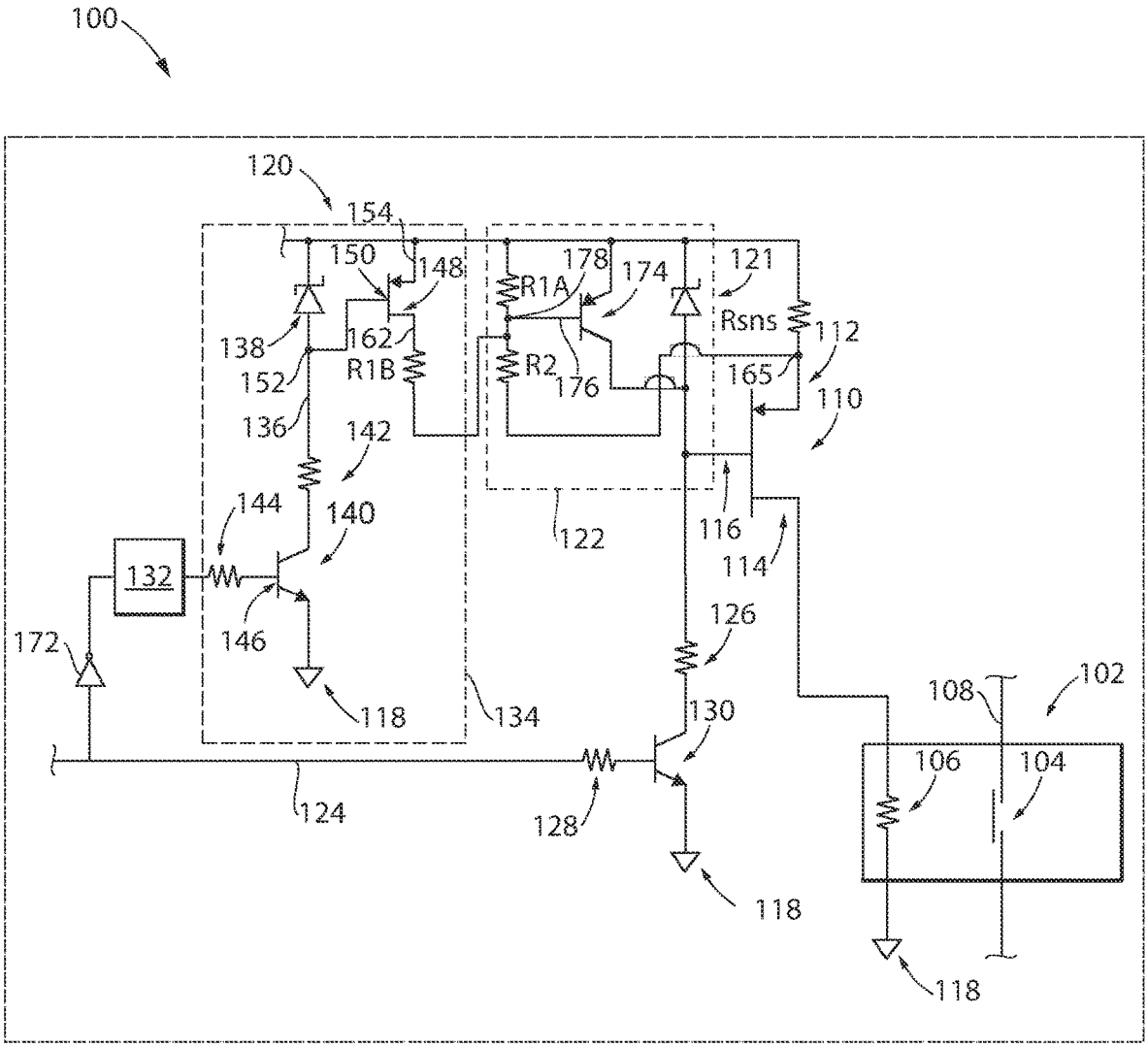
FIG. 3 is a schematic perspective view of an embodiment of a system constructed in accordance with the present disclosure, showing a bipolar junction transistor (BJT) based current source.

In another configuration shown in FIG. 3, the current source control circuit 122 can include a bipolar junction transistor (BJT) based current source. The delay circuit 132 is connected to the close command line 124 through an inverter gate 172. The BJT based current source includes a BJT 174 connected between the voltage source 120 and the gate 116 of the pass element 110. A base 176 of the BJT 174 can connect to a voltage divider node 178 between a first resistor R1A and a second resistor R2 connected in series with one another between the voltage source 120 and the current sense resistor Rsns. The drain 162 of the secondary pass element 148 connects to the voltage divider node 178 through a third resistor R1B. In the configuration of FIG. 3, when a signal is sent on the command line 124, the delay circuit 132 begins a countdown and the first, higher current for pull-in mode is applied to the coil 106. Resistor R1B is in parallel with the resistor R1A in this state. After the countdown is completed, the resistor R1B is removed from being in parallel with the resistor R1A, lowering the current commanded by the voltage output of BJT 174, to lower the current applied to the coil 106 for hold mode.

A method includes signaling a current source control circuit (e.g. current source control circuit 122) to close a contactor (e.g. contactor 102). The method includes signaling a delay circuit (e.g. delay circuit 132) to start a countdown, supplying a first current to the contactor while the contactor is transitioning from open to closed in a pull-in mode of the contactor, and supplying a second current to the contactor after the contactor is closed in a hold mode of the contactor. The second current is lower than the first current, and supplying the second current is in response to the delay circuit completing the count down.

Supplying the second current can include reversing current through a Zener diode, e,g, Zener diode 138, in order to provide a fixed gate-source voltage to turn on pass element 154. When the pass element turns on, it manipulates the resistor network (e.g. R1, R1A, R1B, and/or R2 of FIGS. 1-3) to provide a different current command to the current source control circuit 122. Supplying the first current and supplying the second current can include using a linear regulator current source, e.g. as in FIGS. 1 and 2. It is also contemplated that supplying the first current and supplying the second current can include using a bipolar junction transistor (BJT) circuit, e.g. as in FIG. 3. Supplying the first current and supplying the second current can be accomplished by a drive wherein the drive is a current source rather than an on/off switch to guarantee coil current. The drive can command a different current during pull-in than during the hold mode.

The methods and systems of the present disclosure, as described above and shown in the drawings, provide for contactor control with improved economizer operations using a current source rather than an on/off switch to guarantee coil current. This can allow for avoidance of de-energizing the contactor due to a trip in the drive circuitry, for example. While the apparatus and methods of the subject disclosure have been shown and described with reference to preferred embodiments, those skilled in the art will readily appreciate that changes and/or modifications may be made thereto without departing from the scope of the subject disclosure.

What is claimed is:

1. A method comprising:

signaling a current source control circuit to close a contactor;

signaling a delay circuit to start a count down;

supplying a first current to the contactor while the contactor is transitioning from open to closed in a pull-in mode of the contactor; and supplying a second current to the contactor after the contactor is closed to a hold mode of the contactor, wherein the second current is lower than the first current, and wherein supplying the second current is in response to the delay circuit completing the count down, wherein supplying the second current includes reversing current through a Zener diode in a Zener diode line, wherein the Zener diode line runs from a voltage source to ground, wherein the Zener diode line includes in order running from the voltage source to ground, the Zener diode, a resistor, and a bipolar junction transistor (BJT), wherein the Zener diode has a Zener voltage configured to inhibit current flowing to the BJT below the Zener Voltage.

2. The method as recited in claim 1, supplying the first current and supplying the second current is accomplished by a drive wherein the drive is a current source rather than an on/off switch to guarantee coil current.

3. The method as recited in claim 2, wherein the drive commands a different current during pull-in than during the hold mode.

4. The method as recited in claim 1, wherein supplying the first current and supplying the second current include using a linear regulator current source.

5. The method as recited in claim 1, wherein supplying the first current and supplying the second current include using a bipolar junction transistor (BJT) circuit.

* * * * *